US009845659B2

(12) United States Patent
Madell et al.

(10) Patent No.: US 9,845,659 B2
(45) Date of Patent: Dec. 19, 2017

(54) FUSIBLE ALLOY PLUG IN FLOW CONTROL DEVICE

(71) Applicants: ConocoPhilips Company, Houston, TX (US); Total E&P Canada, Ltd., Calgary (CA)

(72) Inventors: Garret Madell, Calgary (CA); John Lowell Stalder, Houston, TX (US); Jesse Stevenson, Calgary (CA)

(73) Assignees: ConocoPhillips Company, Houston, TX (US); Total E&P Canada Ltd., Calgary (CA)

( * ) Notice: Subject to any disclaimer, the term of this patent is extended or adjusted under 35 U.S.C. 154(b) by 96 days.

(21) Appl. No.: 14/292,340

(22) Filed: May 30, 2014

(65) Prior Publication Data

US 2015/0000927 A1 Jan. 1, 2015

Related U.S. Application Data

(60) Provisional application No. 61/841,645, filed on Jul. 1, 2013.

(51) Int. Cl.

| | |
|---|---|
| ***E21B 43/08*** | (2006.01) |
| ***E21B 34/06*** | (2006.01) |
| ***E21B 36/00*** | (2006.01) |
| ***E21B 43/10*** | (2006.01) |
| ***E21B 43/24*** | (2006.01) |

(52) U.S. Cl.

CPC ..... *E21B 34/063* (2013.01); *E21B 36/006* (2013.01); *E21B 43/08* (2013.01); *E21B 43/10* (2013.01); *E21B 43/2406* (2013.01)

(58) Field of Classification Search

USPC ..... 166/373, 317, 205

See application file for complete search history.

(56) References Cited

U.S. PATENT DOCUMENTS

| | | | | |
|---|---|---|---|---|
| 3,273,641 | A | 9/1966 | Bourne | |
| 5,479,986 | A | 1/1996 | Gano | |
| 5,607,017 | A | 3/1997 | Owens | |
| 5,685,372 | A | 11/1997 | Gano | |
| 5,765,641 | A | 6/1998 | Shy | |
| 6,220,350 | B1 | 4/2001 | Brothers | |
| 7,380,600 | B2 | 6/2008 | Wilberg | |
| 7,409,999 | B2 | 8/2008 | Henriksen | |
| 7,673,678 | B2 | 3/2010 | MacDougall | |
| 8,276,670 | B2 | 10/2012 | Patel | |
| 2008/0156498 | A1* | 7/2008 | Phi | E21B 43/26 166/376 |
| 2011/0247834 | A1* | 10/2011 | Gambier | E21B 33/05 166/386 |
| 2013/0075112 | A1 | 3/2013 | Franklin | |

FOREIGN PATENT DOCUMENTS

WO PCT/US14/040326 9/2014

* cited by examiner

*Primary Examiner* — Taras P Bemko

(74) *Attorney, Agent, or Firm* — Boulware & Valoir

(57) ABSTRACT

A "passive" apparatus and method for isolating flow within a thermal wellbore wherein inflow apertures are plugged with a temporary fusible alloy plug that can be selectively removed by increasing the wellbore temperature.

1 Claim, 5 Drawing Sheets

FIGURE 3

| CERRO ALLOY NAME | NUMBER | Bi. | Pub | Sun | Cd. | in. | OTHER | MELTING RANGE DEGREES FAIR. | YIELD TEMP. DEGREES FAIR. |
|---|---|---|---|---|---|---|---|---|---|
| CERROLOW-105 | 4291-1 | 42.91 | 21.70 | 797 | 5.09 | 18.33 | 4.00 Hg. | 100-110 | 105 |
| CERROLOW-117 | 4470-2 | 44.70 | 22.60 | 8.30 | 5.30 | 19.10 | | 117-117 | 117 |
| CERR0LOW-117B | 4470-4 | 44.70 | 22.60 | 11.30 | 5.30 | 16.10 | | 117-126 | 117 |
| | 4914-1 | 49.14 | 17.92 | 11.55 | 0.50 | 20.89 | | 129-133 | 132 |
| CERR0LOW-136 | 4900-2 | 49.00 | 18.00 | 12.00 | | 21.00 | | 136-136 | 136 |
| CERROLOW-136B | 4900-3 | 49.00 | 18.00 | 15.00 | | 18.00 | | 136-156 | 136 |
| CERROLOW-140 | 4750-2 | 4750 | 25.40 | 12.60 | 9.50 | 5.00 | | 134-149 | 140 |
| | 3250-1 | 32.50 | | | | | | | |
| CERROLOW-147 | 4800-2 | 48.00 | 25.63 | 12.77 | 9.60 | 4.00 | | 142-149 | 147 |
| CERROBEND | 5000-7 | 50.00 | 26.70 | 13.30 | 10.00 | | | 158-158 | 158 |
| WOOD'S METAL | 5000-8 | 50.00 | 25.00 | 12.50 | 12.50 | | | 158-165 | 158 |
| | 5000-8A | 50.00 | 24.95 | 12.50 | 12.50 | | .05 Acs | 158-165 | 158 |
| | 5050-1 | 50.50 | 27.80 | 12.40 | 9.30 | | | 158-163 | 159 |
| | 5000-6 | 50.00 | 34.50 | 9.30 | 6.20 | | | 158-173 | 162 |
| | 4050-1 | 40.50 | 27.80 | 22.40 | 9.30 | | | 158-215 | 163 |
| CERROSAFE | 4250-2 | 42.50 | 37.70 | 11.30 | 8.50 | | | 160-190 | 165 |
| | 3530-1 | 35.30 | 35.10 | 20.10 | 9.50 | | | 158-221 | 169 |
| | 4000-3 | 40.00 | 33.34 | 13.33 | 13.33 | | | 162-235 | 169 |
| CERROLOW-174 | 5700-1 | 57.00 | | 17.00 | | 26.00 | | 174-174 | 174 |
| | 5000-2 | 50.00 | 39.00 | 4.00 | 7.00 | | | 165-200 | 174 |
| | 5000-3 | 50.00 | 39.00 | 3.00 | 8.00 | | | 17-180 | 189 |
| | 5031-2 | 50.31 | 39.20 | 1.50 | 7.99 | 1.00 | | | 181 |
| CERRODENT | 3814-1 | 38.14 | 26.42 | 3167 | 2.64 | .06 Cu | 1.07 Sub. | 167-244 | 11 |
| | 5031-1 | 50.31 | 39.20 | 1.00 | 8.00 | 1.49 | | 178-185 | 183 |
| | 5090-1 | 50.90 | 31.10 | 15.00 | 1.00 | 2.00 | | 176-192 | 187 |
| | 5108-1 | 51.08 | 39.80 | | 8.12 | 1.00 | | 188-192 | 190 |
| | 3070-1 | 30.70 | 46.00 | 18.20 | 5.10 | | | 158-253 | 190 |
| | 5200-1 | 52.00 | 31.67 | 15.33 | 1.00 | | | 181-198 | 192 |
| | 5145-1 | 51.45 | 31.35 | 15.20 | | 2.00 | | 190-200 | 194 |
| | 5160-1 | 51.60 | 40.20 | | 8.20 | | | 197-197 | 197 |
| | 4525-1 | 45.25 | 32.75 | | 22.00 | | | 197-316 | 197 |
| | 5200-2 | 52.00 | 31.70 | 15.30 | | 1.00 | | 195-201 | 198 |
| | 5250-1 | 52.50 | 32.00 | 15.55 | | | | 203-203 | 203 |
| | 5000-5 | 50.00 | 30.00 | 20.00 | | | | 203-219 | 203 |
| | 5000-1 | 50.00 | 25.00 | 25.00 | | | | 203-239 | 203 |
| | 5600-1 | 56.00 | 22.00 | 22.00 | | | | 203-219 | 205 |
| | 4640-2 | 51.60 | 33.60 | 20.00 | | | | 203-227 | 208 |
| | 4500-1 | 45.00 | 35.00 | 20.00 | | | | 205-225 | 210 |
| | 3650-1 | 36.50 | 31.75 | 31.75 | | | | 203-279 | 212 |
| | 3650-2A | 36.50 | 31.70 | 31.50 | 0.25 | | .05 Ag. | 203-277 | 212 |
| | 3841-2A | 38.41 | 30.77 | 30.77 | | | .05 Ag. | 205-275 | 212 |
| | 5220-2 | 52.20 | 37.80 | 10.00 | | | | 208-221 | 212 |

FIGURE 3 (continued)

| CERRO ALLOY NAME | NUMBER | Bi. | Pub | Sun | Cd. | in. | OTHER | MELTING RANGE DEGREES FAIR. | YIELD TEMP. DEGREES FAIR. |
|---|---|---|---|---|---|---|---|---|---|
| | 5163-1 | 51.63 | 4139 | 6989 | | | | 208-234 | 216 |
| | 5400-1 | 54.00 | | 26.00 | 20.00 | | | 216-217 | 217 |
| | 5160-2 | 51.60 | 5.00 | 37.40 | | 6.00 | | 203-264 | 218 |
| | 5452-2 | 54.52 | 39.48 | 6.00 | | | | 215-226 | 219 |
| | 5273-1 | 52.73 | 42.27 | 5.00 | | | | 217-243 | 220 |
| | 5439-2 | 54.39 | 43.61 | 1.00 | 1.00 | | | 219-235 | 222 |
| | 5685-1 | 56.85 | 41.15 | | 2.00 | | | 197-250 | 222 |
| | 5298-1 | 52.98 | 42.49 | 4.53 | | | | 217-243 | 227 |
| | 3200-1 | 32.00 | 34.00 | 34.00 | | | | 205-271 | 232 |
| | 3333-1 | 33.33 | 33.34 | 33.33 | | | | 205-289 | 232 |
| | 5375-1 | 53.75 | 43.10 | 3.15 | | | | 226-246 | 237 |
| | 3080-1 | 30.80 | 38.40 | 30.80 | | | | 205-282 | 241 |
| CERROMATRIX | 4800-1 | 48.00 | 28.50 | 14.50 | | | 9.00 Sub. | 217-440 | 241 |
| | 5500-1 | 55.00 | 44.00 | 1.00 | | | | 242-248 | 246 |
| | 5500-3 | 55.00 | 44.00 | | | 1.00 | | 248-250 | 249 |
| CERROSEAL-35 | 0000-18 | | | 50.00 | | 50.00 | | 240-260 | 244 |
| | 2850-1 | 28.50 | 43.00 | 28.50 | | | | 205-279 | 250 |
| CERROBASE | 5550-1 | 56.50 | 44.50 | | | | | 255-255 | 255 |
| | 5800-1 | 58.00 | 42.00 | | | | | 255-259 | 256 |
| | 5510-1 | 55.10 | 5.00 | 39.90 | | | | 250-277 | 259 |
| | 2550-1 | 25.50 | 14.50 | 60.00 | | | | 205-356 | 270 |
| | 5684-2 | 56.84 | 2.00 | 41.16 | | | | 262-271 | 270 |
| | 0500-2 | 5.00 | 32.00 | 45.00 | 18.00 | | | 270-282 | 275 |
| | 5742-3 | 57.42 | 1.00 | 41.58 | | | | 275-275 | 275 |
| | 2150-1 | 21.50 | 51.50 | 27.00 | | | | 268-338 | 276 |
| CERROTRU | 5800-2 | 58.00 | | 42.00 | | | | 281-281 | 281 |
| | 4545-1 | 45.45 | 54.55 | | | | | 253-320 | 286 |
| | 2100-1 | 21.00 | 42.00 | 37.00 | | | | 248-306 | 288 |
| | 6000-1 | 60.00 | | | 40.00 | | | 291-291 | 291 |
| | 2000-4 | 20.00 | 50.00 | 30.00 | | | | 266-343 | 293 |
| | 1600-1 | 16.00 | 36.00 | 48.00 | | | | 284-324 | 302 |
| CERROCAST | 4000-4 | 40.00 | | 60.00 | | | | 281-338 | 302 |
| | 1400-1 | 14.00 | 43.00 | 43.00 | | | | 291-325 | 309 |
| | 1260-1 | 12.60 | 47.47 | 39.93 | | | | 294-349 | 318 |
| | 1000-2 | 10.00 | 40.00 | 50.00 | | | | 248-332 | 324 |
| | 0400+1 | 4.00 | 55.50 | 40.50 | | | | 338-388 | 343 |
| | 9500-1 | 95.00 | | | | | | 273-483 | 357 |
| | | | | | | | | | |

OTHER SPECIAL ALLOYS AVAILAVLE ON REQUEST Revised 6-24-82 Form HQ-948

FIGURE 4

| Type / Approx. Temp. (°F ) | Antimony | Bismuth | Cadmium | Lead | Tin | Indium |
|---|---|---|---|---|---|---|
| Low 117 | 0 % | 44.7% | 5.3% | 22.6% | 8.3% | 19.1% |
| Low 136 | 0 % | 49% | 0% | 18% | 12% | 21% |
| Low 140 | 0 % | 47.5% | 9.5% | 25.4% | 12.6% | 5% |
| Low 147 | 0 % | 48% | 9.6% | 25.6% | 12.8% | 4% |
| Low 158 | 0 % | 50% | 10% | 26.7% | 13.3% | 0% |
| Low 158-190 | 0 % | 42.5% | 8.5% | 37.7% | 11.3% | 0% |
| Low 203 | 0% | 52.5% | 0% | 32% | 15.5% | 0% |
| Low 212 | 0% | 39.4% | 0% | 29.8% | 30.8% | 0% |
| Low 217-440 | 9% | 48% | 0% | 28.5% | 14.5% | 0% |
| Low 255 | 0% | 55.5% | 0% | 44.5% | 0% | 0% |
| Low 281 | 0% | 58% | 0% | 0% | 42% | 0% |
| Low 281-338 | 0% | 40% | 0% | 0% | 60% | 0% |

FUSIBLE ALLOY PLUG IN FLOW CONTROL DEVICE

PRIOR RELATED APPLICATIONS

This application claims priority to U.S. Application Ser. No. 61/841,645, filed Jul. 1, 2013, and is expressly incorporated by reference herein in its entirety for all purposes.

FEDERALLY SPONSORED RESEARCH STATEMENT

Not applicable.

FIELD OF THE DISCLOSURE

This invention relates to an apparatus and method for isolating flow within a thermal wellbore.

BACKGROUND OF THE DISCLOSURE

Many different tasks may be performed in a wellbore. For example, perforating guns may be shot to create perforations in a target formation in order to produce well fluids to the surface; different zones in a wellbore may be sealed with packers; plugs may be set at desired depths to isolate portions of a wellbore; a casing patch may be activated to patch openings in a casing or other type of liner; or sand screens may be installed to control production of sand. In addition to completion equipment, other tools for use in wellbores may include drilling equipment, logging equipment, and so forth.

The tools for performing these various operations may include many different types of elements. For example, the tools may include explosives, sealing elements, expandable elements, tubings, casings, and so forth. Operation, translation, actuation, or even enlargement of such elements may be accomplished in a number of different ways. For example, mechanisms that are electrically triggered, fluid pressure triggered, mechanically triggered, thermally triggered, chemically triggered, and explosively triggered may be employed.

Mechanical and hydraulic systems have been implemented in the past, however, the major disadvantages to these type of systems include complexity, moving parts, dependability of actuation, the need for intervention (mechanical shifting) and the individual vendor application (non-interchangeability).

Although improvements in downhole technology have been implemented for operating, translating, actuating, or performing other tasks with downhole elements, a need continues to exist for further improvements in such mechanisms. In particular, a simple easy method for isolating flow within a wellbore is needed, wherein the flow shut off mechanism can be passively removed, e.g., without retrieval or other complex methods of removal.

SUMMARY OF THE DISCLOSURE

The disclosure relates to an apparatus for isolating flow within a wellbore. The system components include a flow control device, usually used in combination with an exclusion media to limit the flow of formation materials. The flow control device includes at least one aperture formed therein, wherein the aperture restricts hydraulic flow.

A temporary fusible alloy plug is securely installed into the aperture, wherein the temporary fusible alloy plug is fabricated from a low melting temperature composition that is meltable under heated reservoir conditions, and thus is passively removed during normal steam circulation or injection operations.

The fusible plug is pre-dominantly used with, but not limited to isolated flow control devices during deployment in Steam Assisted Gravity Drainage ("SAGD") wellbores and other thermal wellbores.

The primary characteristic differentiating this invention is the passive, fusible removal of the plugs. The plug materials are otherwise not affected by time or environmental exposure (weather), normal circulation of water base or oil-base drilling or completion fluids and do not require any incremental mechanical or chemical intervention operations to remove. Rather, heat (e.g., steam stimulation) for a period of time suffices to remove the plug.

A fusible alloy is a metal alloy capable of being easily fused, i.e., easily meltable, at relatively low temperatures. Fusible alloys are commonly, but not necessarily, eutectic alloys. The word "eutectic" describes an alloy, which, like pure metals, has a single melting point. This melting point is usually lower than that of any of the constituent metals. Thus, pure Tin melts at 449.4° F. and pure Indium at 313.5° F. but combined in proportion 48% Tin and 52% Indium, they form a eutectic alloy that melts at 243° F. Sometimes the term "fusible alloy" is used to describe alloys with a melting point below 150° C. (302° F.). Fusible alloys in this sense are used for solder.

From practical view, low melting alloys can be divided up into:

- Mercury-containing alloys
- Only alkali metal-containing alloys
- Gallium-containing alloys (but neither alkali metal nor mercury)
- Only bismuth, lead, tin, cadmium, zinc, indium and sometimes thallium-containing alloys
- Other alloys (rarely used)

Some reasonably well known fusible alloys are Wood's metal, Field's metal, Rose metal, Galinstan, NaK, and Onion's fusible alloy.

In another embodiment, an apparatus for isolating flow within a wellbore includes a flow control device including at least one aperture formed therein, wherein the aperture restricts hydraulic flow; and a temporary fusible alloy plug securely installed into the aperture, wherein the temporary fusible alloy plug is fabricated from any low melting temperature alloy that is meltable, for effective removal during normal steam circulation or injection operations.

In a further embodiment, a method for isolating flow within a wellbore includes obtaining a flow control device, wherein the flow control device includes at least one aperture formed therein, wherein the flow control device includes an exclusion media, wherein the exclusion media limits the flow of formation materials; inserting a temporary fusible alloy plug securely into the aperture, wherein the temporary fusible alloy plug temporarily prevents flow through the aperture, wherein the temporary fusible alloy plug is fabricated from any low melting temperature alloy that is meltable, and is removed during normal steam circulation or injection operations.

In yet another embodiment, a method for isolating flow within a wellbore includes obtaining a flow control device, wherein the flow control device includes at least one aperture formed therein; inserting a temporary fusible alloy plug securely into the aperture, wherein the temporary fusible alloy plug temporarily prevents flow through the aperture, wherein the temporary fusible alloy plug is meltable, heating the reservoir, and thus passively removing the temporary fusible alloy plug. Preferably, the removal occurs during normal steam circulation or injection operations.

Yet another embodiment is an improved flow control device for a wellbore, said flow control device having apertures for selective inflow of fluids, the improvement comprising blocking said apertures with temporary fusible alloy plugs which melt at a temperature $T_m$, which is higher than the normal reservoir temperatures.

In still other embodiments, a series of flow control devices are used, each having different melt temperature plugs so that differential flow control along the length of a wellbore can be achieved.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, buffers, and the like.

The term "temporary" as used herein means that the plugs of the invention can be melted, and removed under suitable thermal condition in a period of time less than one month so as to allow free fluid flow through the previously plugged aperture. Preferably, the plugs can be removed in less than a week, or even less than one or two days on provision of the appropriate thermal stimulus.

The term "fusible" as used herein means capable of being liquefied by heat.

As used herein, the term "alloy" is used as is typical in the art, e.g., containing two or more metallic elements, esp. to give greater strength or resistance to corrosion and exhibit the characteristics of lower temperature melting point.

The term "plug" as used herein means a solid material capable of blocking at least 98% of fluid flow through an aperture or inlet/outlet.

The phrase "temporary fusible alloy plugs" refers to a solid material comprising two or more metals in the shape designed to block fluid flow through an aperture, wherein the matrix of the plug is such as to be degradable on a particular stimulus, thus again allowing fluid flow.

As used herein "stimulus" refers to an initiating event that starts plug degradation or removal. Such stimulus is thermal, and preferably, the heat is provided as steam, as normally scheduled for during completion and production operations.

The use of the word "passive" herein mans that the plug can be removed without mechanical or electrical intervention, merely on the addition of the stimulus, such as heat, as would normally occur in any steam or heat well stimulations.

As used herein, "exclusion media" can be any known or developed in the art that prevents formation materials from entering the wellbore or flow control device. Typically, slotted liners, screens, or particulates, such as sand or fine gravel are used for this.

BRIEF DESCRIPTION OF THE DRAWINGS

The invention, together with further advantages thereof, may best be understood by reference to the following description taken in conjunction with the accompanying drawings in which:

FIG. 3 is a list of fusible alloys available from Canada Metal (Quebec, CA).

FIG. 4 shows additional alloys available from Reade Advanced Materials (R.I., USA).

DETAILED DESCRIPTION OF THE INVENTION

Figure 1:
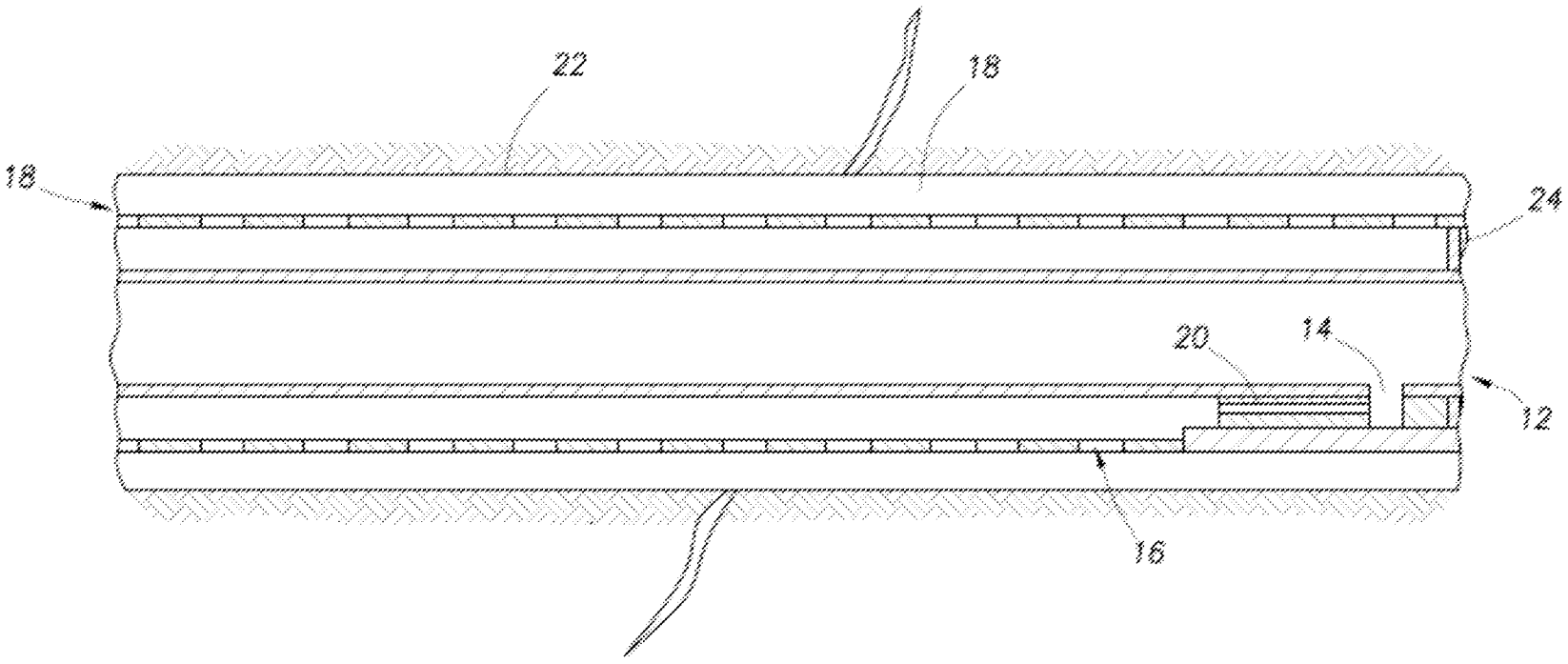
FIG. 1 is a schematic side view of an embodiment of the present invention.

The present disclosure describes a novel device for control flow in an oil reservior and methods of use thereof. Specifically, temporary fusible alloy plugs are used in flow control devices. The plug can be passively removed upon contact with high temperatures.

The disclosure includes one or more of the following embodiments, in any combination:

An apparatus for isolating flow within a wellbore comprising a flow control device with an exclusion media, wherein the flow control device includes at least one aperture formed therein, wherein the aperture restricts hydraulic flow, wherein the exclusion media limits the flow of formation materials; and a temporary fusible alloy plug securely installed into said at least one aperture, wherein the temporary fusible alloy plug can be passively removed upon thermal circulation or injection operations.

An apparatus for isolating flow within a wellbore comprising a flow control device, wherein the flow control device includes at least one aperture formed therein, wherein the aperture restricts hydraulic flow; and a temporary fusible alloy plug securely installed into the aperture, wherein the temporary fusible alloy plug is fabricated from any low melting temperature composition comprising a meltable, removable material. The flow control device can also have exclusion media.

The above apparatuses can have orifices, perforations, nozzles, capillaries, tubing and valves to restrict hydraulic flow. Additionally, exclusion media can include a perforated pipe, a slotted pipe, a screened pipe, meshed pipe, a sintered pipe, or any means that limits the inflow of particulates.

A method for isolating flow within a wellbore comprising obtaining a flow control device, wherein the flow control device includes at least one aperture formed therein, wherein the flow control device includes an exclusion media, wherein the exclusion media limits the inflow of formation materials; inserting a temporary fusible alloy plug securely into the aperture, wherein the temporary fusible alloy plug temporarily prevents flow through the aperture, wherein the temporary fusible alloy plug is fabricated from any low melting temperature composition that is meltable at a $T_m$; installing the flow device into the well; and increasing the reservoir temperature to $T_m$ and removing said temporary fusible alloy plug when inflow through said aperture is desired.

A method for isolating flow within a wellbore comprising obtaining a flow control device, wherein the flow control device includes at least one aperture formed therein; inserting a temporary fusible alloy plug securely into the aperture, wherein the temporary fusible alloy plug temporarily prevents flow through the aperture, wherein the temporary fusible alloy plug; installing the flow device into the well; and injecting steam into said wellbore when it is desired to remove said temporary fusible alloy plug.

The apertures can be an orifice, a perforation, a nozzle, a capillary, tubing, a valve or combinations thereof. Furthermore, the exclusion media can include a perforated pipe, a slotted pipe, a screened pipe, meshed pipe, a sintered pipe, or any means that limits the inflow of particulates.

An improved flow control device ("FCD") for a wellbore, said FCD having apertures for selective inflow of fluids, the improvement comprising blocking said apertures with temporary fusible alloy plugs which melt at a temperature $T_m$, which is higher than the normal reservoir temperatures.

Figure 2:
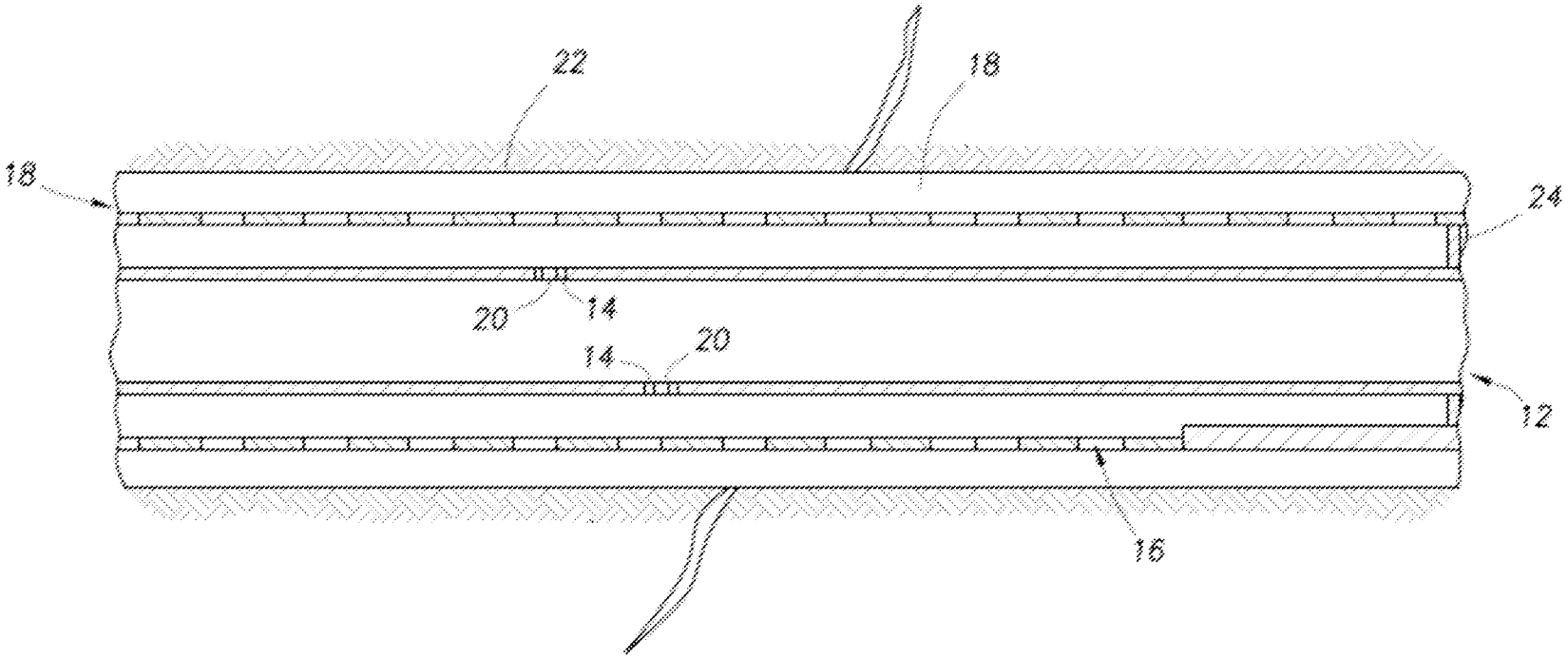
FIG. 2 is a schematic side view of an embodiment of the present invention.

Referring to FIGS. 1 and 2, a portion of a wellbore 12 may be completed with a flow control liner 22. The flow control liner includes a string of pipe joints 16 incorporating one or more flow control device(s) (FCD) 14 and an exclusion media 24, which limits the flow of sand grains and reservoir particulates into the liner. Each flow control device 14 may include at least one aperture, which restricts hydraulic flow. The aperture may be orifices, perforations, nozzles, capillaries, tubes, and/or valves. The exclusion media 24 may be a perforated pipe, a slotted pipe, a screened pipe, meshed pipe, a sintered pipe, or any means that limits the flow of formation materials, such as sand or other particulate filtration media. While the exclusion media is depicted in FIGS. 1 and 2, the operator can determine whether use of the exclusion media is necessary.

Prior to installation of the flow control liner into the wellbore, temporary fusible alloy plugs 20 may be securely installed in the apertures of each FCD. The temporary fusible alloy plug enables the liner to be installed while circulating fluids through the inside of the liner, out the toe end of the liner and back through the annulus outside the liner without allowing the fluid to pass through the plugged FCD restrictors. This protects the exclusion media from being plugged with fine particles contained in the circulating fluids.

Alternatively, the plugged flow control devices 14 allow the liner to be floated, thereby, reducing effective normal side loads. The ability to float the liner further reduces torque and drag forces allowing the liner to be run in shallower true vertical depths with longer lateral intervals.

The fusible alloy plug composition is preferably non-toxic and non-damaging to the wellbore or the inflow control device. Furthermore, the temporary fusible alloy plug may be removed from the inflow control device with steam circulation. The fusible alloy plug may be fabricated from any low melting temperature composition that is meltable, for effective removal during normal steam circulation or injection operations. These low melting temperature compositions may include but are not limited to bismuth, lead, tin, cadmium, indium, solder or other alloys.

In one aspect, the fusible alloy plug can include a biodegradable material that can be effectively removed when exposed to a set of predetermined thermal conditions. The thermal conditions can include normal or 'thermal' wellbore operating conditions of increased temperature during the completion or production operations. In other words, no special chemicals, acids, sources of radiation, abrasive particles, pressure, etc. need to be introduced into the wellbore or carried within the downhole tool itself to initiate the removal of the fusible plug, which will automatically be removed by pre-determined thermal wellbore conditions.

It may be possible to use different melting points of the plugs so that they may be selectively removed to further allocate the flow distribution control of the liner system. For example, some joints of the liner may employ temporary fusible alloy plugs that require increased temperature removal prior to other plugs that can be opened at even higher temperature thermal operations. This concept would allow initiating flow at some point in the liner system prior to opening up primary flow throughout the liner system. This may have advantages for selectively opening specific sections after installation to allow circulation prior to initiating final overall thermal operations.

In the event the operator installs the inflow control device containing the fusible alloy plugs into the wellbore, annular fluids can be circulated from the wellbore into the annulus 18 prior to the completion from newly drilled thermal wells in order to recover drilling fluids, minimize the volumes of the fluids for disposal and further minimizing flow cleanup time. Additionally, preventing drilling fluid flow through the inflow control device during filling or circulating should ensure limited premature solid plugging of the sand exclusion media.

The "passive" flow control apparatus described herein does not require moving parts, mechanical or hydraulic intervention, thus providing significant advantages over that of non-passive systems.

Exemplary low melting alloys are shown in Table 1 below. Preferred allows are solid at typical reservoir temperatures, but melt on steam or other heating of the reservoir. Preferred melt temperatures are >100° C., >150° C., >200° C., but <300° C., or <250° C., but there may be some variability based on reservoir location and conditions. For example, Athabasca oil sands are typically at 7-11° C., and thus lower melt temperature alloys can be used. In contrast, the Texas reservoir at San Miguel is at about 35° C. (95° F.).

Particularly preferred alloys are chemically stable to water, oil, bitumen, and the various additives that may be present, and avoid the use of toxic heavy metals, such as lead and mercury. As mentioned above, different temperature melting plugs can be used at different positions along the wellbore, lower melt temperature ($T_m$) plugs melting first.

TABLE 1

EXEMPLARY FUSIBLE ALLOYS

| Composition in weight-percent | ° C. | Eutectic | Common Name |
|---|---|---|---|
| Bi 100 | 271.5 | (yes) | |
| Bi 32.5, In 51.0, Sn 16.5 | 60.5 | yes | Field's metal |
| Bi 40.3, Pb 22.2, In 17.2, Sn 10.7, Cd 8.1, Tl 1.1 | 41.5 | yes | |
| Bi 40.63, Pb 22.1, In 18.1, Sn 10.65, Cd 8.2 | 46.5 | | |
| Bi 49.5, Pb 27.3, Sn 13.1, Cd 10.1 | 70.9 | yes | Lipowitz's alloy |
| Bi 50, Lead 30, Sn 20, Impurities | 92 | no | Onions' Fusible Alloy |
| Bi 50.0, Pb 25.0, Sn 12.5, Cd 12.5 | 71 | no | Wood's metal |
| Bi 50.0, Pb 28.0, Sn 22.0 | 109 | no | Rose's metal |
| Bi 50.0, Pb 31.2, Sn 18.8 | 97 | no | Newton's metal |
| Bi 52.5, Pb 32.0, Sn 15.5 | 95 | yes | |
| Bi 56.5, Pb 43.5 | 125 | yes | |
| Bi 58, Sn 42 | 139 | yes | |
| Cs 100 | 28.6 | (yes) | |
| Cs 73.71, K 22.14, Na 4.14 | −78.2 | yes | |
| Cs 77.0, K 23.0 | −37.5 | | |
| Ga 100 | 29.8 | (yes) | |

TABLE 1-continued

EXEMPLARY FUSIBLE ALLOYS

| Composition in weight-percent | ° C. | Eutectic | Common Name |
|---|---|---|---|
| Ga 61, In 25, Sn 13, Zn 1 | 8.5 | yes | |
| Ga 62.5, In 21.5, Sn 16.0 | 10.7 | yes | |
| Ga 68.5, In 21.5, Sn 10 | −19 | no | Galinstan |
| Ga 69.8, In 17.6, Sn 12.5 | 10.8 | no | |
| Ga 75.5, In 24.5 | 15.7 | yes | |
| Hg 100 | −38.8 | (yes) | |
| Hg 91.5, Tl 8.5 | −58 | yes | used in low readings thermo-meters |
| In 100 | 157 | (yes) | |
| In 66.3, Bi 33.7 | 72 | yes | |
| K 76.7, Na 23.3 | −12.7 | yes | |
| K 78.0, Na 22.0 | −11 | no | NaK |
| Sn 62.3, Pb 37.7 | 183 | yes | |
| Sn 63.0, Pb 37.0 | 183 | no | Eutectic solder |
| Sn 91.0, Zn 9.0 | 198 | yes | |
| Sn 92.0, Zn 8.0 | 199 | no | Tin foil |
| Zn 100 | 419.5 | (yes) | |

A wide variety of fusible alloys are commercially available. FIG. 3 provides a list of fusible alloys available from Canada Metal with a wide range of melt temperatures, and a few more from Reade Advanced Materials are found in FIG. 4.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

All references cited herein are expressly incorporated by reference in their entireties for all purposes. The discussion of any reference is not an admission that it is prior art to the present invention, especially any reference that may have a publication date after the priority date of this application. Incorporated references are listed again here for convenience:

U.S. Pat. No. 7,409,999 Downhole inflow control device with shut-off feature

U.S. Pat. No. 8,276,670 Downhole dissolvable plug

U.S. Pat. No. 5,479,986 Temporary plug system

U.S. Pat. No. 5,607,017 Dissolvable well plug

U.S. Pat. No. 5,685,372 Temporary plug system

U.S. Pat. No. 5,765,641 Bidirectional disappearing plug

U.S. Pat. No. 6,220,350 High strength water soluble plug

U.S. Pat. No. 7,380,600 Degradable material assisted diversion or isolation

US20130075112 Wellbore Flow Control Devices Comprising Coupled Flow Regulating Assemblies and Methods for Use Thereof U.S. Pat. No. 7,673,678 Flow control device with a permeable membrane

The invention claimed is:

1. A method for isolating flow within a wellbore comprising:

a) obtaining a plurality of flow control devices, wherein each flow control device includes at least one aperture formed therein, wherein the aperture restricts hydraulic flow of fluids and wherein each flow control device includes an exclusion media to exclude formation particulates, b) inserting a temporary fusible alloy plug securely into said at least one aperture, wherein the temporary fusible alloy plug temporarily prevents flow through said at least one aperture, wherein the temporary fusible alloy plug is fabricated from any low melting temperature composition that is meltable at a melt temperature ($T_m$), such that a first type of flow control device has a plug that melts at $T_{m1}$ and a second type of flow control device has a plug that melts at $T_{m2}$, which is higher than $T_{m1}$;

c) installing the plurality of flow control devices into the well; and d) increasing the reservoir temperature to $T_{m1}$ to selectively remove said temporary fusible alloy plug from said first type of flow control device when inflow through said aperture is desired; and e) increasing the reservoir temperature to $T_{m2}$ to selectively remove said temporary fusible alloy plug from said second type of flow control device when inflow through said aperture is desired.

* * * * *